US007108082B1

(12) United States Patent
Anthony et al.

(10) Patent No.: US 7,108,082 B1
(45) Date of Patent: Sep. 19, 2006

(54) HOLE REAMING APPARATUS AND METHOD

(75) Inventors: Paul G. Anthony, Bakersfield, CA (US); Miles G. Pierson, West Jordan, UT (US)

(73) Assignee: XTech Industries International, Inc., Bakersfield, CA (US)

( * ) Notice: Subject to any disclaimer, the term of this patent is extended or adjusted under 35 U.S.C. 154(b) by 0 days.

(21) Appl. No.: 11/199,009

(22) Filed: Aug. 8, 2005

Related U.S. Application Data

(62) Division of application No. 10/366,496, filed on Feb. 13, 2003, now Pat. No. 6,926,100.

(60) Provisional application No. 60/363,745, filed on Mar. 12, 2002.

(51) Int. Cl.
*E21B 10/60* (2006.01)

(52) U.S. Cl. ..... 175/53; 175/62

(58) Field of Classification Search ..... 175/53, 175/62, 383, 401, 406; 405/138
See application file for complete search history.

(56) References Cited

U.S. PATENT DOCUMENTS

| | | | |
|---|---|---|---|
| 735,770 | A | 8/1903 | Higgins |
| 1,723,381 | A | 8/1929 | Siefert |
| 1,937,742 | A | 12/1933 | Brink |
| 2,085,336 | A | 6/1937 | Sandstone |
| 2,210,824 | A | 8/1940 | Walker, Sr. |
| 2,244,104 | A | 6/1941 | Fitzpatrick |
| 2,472,749 | A | 6/1949 | Lake |
| 2,911,195 | A | 11/1959 | Backer |
| 3,493,268 | A | 2/1970 | Bower, Jr. |
| 3,508,620 | A | 4/1970 | Pennington |
| 3,556,233 | A | 1/1971 | Gilreath et al. |
| 4,406,500 | A | 9/1983 | Treuhaft et al. |
| 4,456,078 | A | 6/1984 | Adam |
| 4,785,885 | A | 11/1988 | Cherrington et al. |
| 5,220,964 | A | 6/1993 | Deken et al. |
| 5,390,750 | A | 2/1995 | Deken et al. |
| 5,485,888 | A | 1/1996 | England |
| 5,687,805 | A | 11/1997 | Perry |
| 5,806,595 | A | 9/1998 | Langford et al. |
| 5,921,331 | A | 7/1999 | Randall |
| 5,979,574 | A | 11/1999 | Osadchuk |
| 6,244,783 | B1 | 6/2001 | Puttmann et al. |
| 6,659,198 | B1 | 12/2003 | Camp |
| 6,755,593 | B1 * | 6/2004 | Wentworth et al. ..... 405/184.3 |
| 2002/0139582 | A1 | 10/2002 | Caraway et al. |
| 2004/0223812 | A1 * | 11/2004 | Wentworth et al. ..... 405/184.3 |

OTHER PUBLICATIONS

"Directional Drilling Tools", *Melfred Borzall*, pp. 6-11, 20-21, 24-27, 2000.

(Continued)

*Primary Examiner*—David Bagnell
*Assistant Examiner*—Daniel P. Stephenson
(74) *Attorney, Agent, or Firm*—Madson & Austin

(57) ABSTRACT

An enhanced reaming apparatus and method are disclosed. A reaming assembly may have a motor and a pump that provide linear force, torsional force, and pressurized drilling fluid to a reamer to cause the reamer to enlarge the bore of a pilot hole. The reamer may have a body and a plurality of blade assemblies that cooperate to define two substantially symmetrical, oppositely oriented reaming sections. Each blade assembly may have an inner blade attached to the body and an outer blade extending outward from the body. Hard cutting elements may be used in place of the outer blade. The blade assemblies may be field-replaced, or the orientation of the reamer may be reversed to enhance the life of the reamer. The reamer has jets and circulation openings that release the drilling fluid into the bore to facilitate penetration and remove cuttings.

3 Claims, 5 Drawing Sheets

OTHER PUBLICATIONS

"Horizontal Directional Drilling Accessories & Tooling", *Vermeer Navigator*, pp. 1-12.

"Products/Backreamers/Shredder Reamer", http://www.melfredborzall.com/prodstyle.asp?SectionID=2&SubSectionID=33, Dec. 16, 2002.

"Products/Backreamers/Shredder Reamer", http://www.melfredborzall.com/prodstyle.asp?SectionID=2&SubSectionID=34, Dec. 16, 2002.

"Products/Backreamers/Shredder Reamer", http://www.melfredborzall.com/prodstyle.asp?SectionID=2&SubSectionID=35, Dec. 16, 2002.

* cited by examiner

HOLE REAMING APPARATUS AND METHOD

CROSS-REFERENCED RELATED APPLICATIONS

This application is a divisional of prior application Ser. No. 10/366,496, filed Feb. 13, 2003 now U.S. Pat. No. 6,926,100, which claims the benefit of U.S. Provisional Application No. 60/363,745 filed Mar. 12, 2002, which is incorporated herein by reference.

BACKGROUND OF THE INVENTION

The present invention relates to systems and methods for drilling in the earth. More specifically, the present invention relates to enhanced reaming assemblies and methods for use in horizontal directional drilling.

In many circumstances, it is desirable to form a hole along a controllable path. For example, when utility lines are to be laid underneath a road, building, or other structure, it may be desirable to drill a generally horizontal hole in the ground rather than forming a trench in which to lay the utility lines. This type of drilling is commonly referred to as "horizontal directional drilling," or "HDD."

According to some known horizontal directional drilling methods, a pilot hole of comparatively small diameter is first formed. The pilot hole is made through the use of a steerable drill bit that is tracked and controlled from the surface. After the pilot hole has been formed along the desired pathway, the pilot hole may be broadened, or "reamed," and the utility lines may be drawn through the hole. A "reamer" is driven and rotated through the pilot hole to perform the reaming operation. A "back reamer" is a reamer that is drawn through the pilot hole, for example, through the use of a drill pipe that also conveys drilling fluid to the back reamer. A reamer may also be pushed through the pilot hole in a manner similar to that of the steerable bit used to form the pilot hole.

Known reamers have a number of limitations. For example, many known reamers wear out rapidly and therefore have a short operating life. Many such reamers have a unitary structure. Thus, excessive wear of any part of the reamer necessitates replacement of the entire reamer.

Some reamers are only usable with a narrow range of subterranean formation types. Thus, multiple reamers may need to be taken to a given job site. If a formation change is encountered during drilling, the entire reamer may need to be replaced with a reamer more suitable for penetrating the new formation.

Furthermore, many known reamers penetrate too slowly. Slow penetration increases the cost of the reaming operation because the motor and pump must sustain more wear and the drilling crew must spend more time at the site to complete the hole. Yet further, many known reamers become clogged or fouled by cuttings from the reaming operation, and must therefore be withdrawn from the hole and re-inserted to continue reaming.

Accordingly, a need exists for a reaming system and method capable of rapidly reaming a pilot hole. Additionally, a need exists for a reamer with exceptional wear resistance, in which parts can be field-replaced to enable continued use of less worn portions of the reamer. Furthermore, a need exists for a reamer that can be easily adapted for different subterranean formation types. Yet further, a need exists for a reamer that facilitates passage of cuttings out of the hole to enable uninterrupted reaming.

BRIEF SUMMARY OF THE INVENTION

The apparatus and method of the present invention have been developed in response to the present state of the art, and in particular, in response to the problems and needs in the art that have not yet been fully solved by currently available reaming systems and methods. Thus, it is an overall purpose of the present invention to provide reaming systems and methods capable of rapidly drilling a hole with little wear and a low incidence of stoppage for unplugging or replacement.

According to one exemplary embodiment, a reaming assembly includes a motor designed to rotate and pull on a length of drilling pipe. The reaming assembly also includes a pump that drives drilling fluid through the drilling pipe at high pressure. The drilling pipe extends into a pilot hole and is attached to a reamer designed to enlarge the pilot hole. Torque and axial tension are transmitted from the motor to the reamer via the drilling pipe to provide mechanical cutting action. The drilling fluid is conveyed to the reamer via the drilling pipe and is expelled from the reamer to enhance penetration and carry away cuttings. Utility lines are attached to the reamer to be drawn through the enlarged bore behind the reamer.

The reamer has a body, a plurality of blade assemblies, a leading subassembly, and a trailing subassembly. In one embodiment, the reamer may have four blade assemblies arrayed about an axis of the body in radially symmetrical fashion. Blade assemblies directly contact the bore of the pilot hole to remove material. The body and the blade assemblies cooperate to form a first reaming section and a second reaming section oriented opposite to the first reaming section and substantially identical to the first reaming section. Thus, the orientation of the reamer can be reversed to equalize wear on both ends of the reamer, thereby lengthening the useful life of the reamer.

The body has a first end, a second end, and an intermediate portion between the first and second ends. The intermediate portion is somewhat wider than the first and second ends. A first generally conical shape provides a transition between the first end and the intermediate portion, and a second generally conical shape provides a transition between the second end and the intermediate portion.

The body has grooves running from the first end to the second end to receive the blade assemblies and permit easy attachment of the blade assemblies to the body. The body has an interior cavity into which the drilling fluid flows from the drilling pipe. First end jets permit the drilling fluid to exit toward the first end, while second end jets permit the drilling fluid to exit toward the second end.

Each of the blade assemblies has a generally bowed shape and includes an inner blade and an outer blade. Each of the inner and outer blades also has a generally bowed shape with a first extremity, a second extremity, and a central portion between the first and second extremities. Each of the outer blades has an outer surface that contacts the bore of the hole and an inner surface that faces the inner blade. The inner and outer blades are attached to each other via a plurality of posts nearly perpendicular to the inner and outer blades. Each of the inner blades has an array of circulation openings through which the drilling fluid can exit the interior cavity to flush cuttings from the outer blades.

The leading subassembly has a hexagonal coupling and a threaded post designed to be engaged within a threaded receptacle of the drilling pipe. The leading subassembly also has an interior passageway through which drilling fluid enters the interior cavity of the reamer from the drill pipe.

The trailing subassembly has an eyelet into which a hook of a hooked coupling can be inserted. The hooked coupling can be coupled to the ends of the utility lines to be drawn through the hole. The eyelet is rotatable via a bearing assembly so that the reamer is able to rotate without twisting the utility lines.

The body may be made of one piece by a method such as casting. Alternatively, the body may be made from multiple pieces. For example, a first portion and a second portion may have cooperating features such as an annular protrusion and an annular recess, respectively, which cooperate to facilitate sturdy attachment of the first and second portions to each other. The first and second portions cooperate to define an interior cavity in communication with jetting holes that feed the first end jets and the second end jets.

The first end of the body has a first coupling, and the second end has a second coupling coaxial with the first coupling. The first and second couplings interchangeably receive the leading and trailing subassemblies. Thus, when the reamer is reversed, the leading and trailing subassemblies can simply be swapped so that the leading subassembly remains at the leading end of the reamer while the trailing subassembly remains at the trailing end.

The body also has a plurality of circulation passageways that supply drilling fluid to the circulation openings of the inner blades. Each of the jets includes a jetting passageway that receives drilling fluid from an associated jetting hole of the interior cavity. Each jetting passageway of the first end jets has a first insert, and each jetting passageway of the second end jets has a second insert. If desired, the inserts pertaining to the leading end (i.e., the first end inserts or the second end inserts) may have orifices sized to permit jetting at the desired flow rate of drilling fluid. The remaining inserts, i.e., the inserts pertaining to the trailing end, may be plugs that concentrate drilling fluid flow through the jets of the leading end of the reamer.

A plurality of blade assemblies may be interchangeably used to enable use of the reamer with a wide variety of subterranean formations. In one embodiment, the outer blades of the blade assemblies may be constructed of a steel such as an AISI ten-series steel. The outer surface of each outer blade may be hardened through a process such as hardfacing to enhance wear resistance.

In one alternative embodiment, a plurality of cutting extensions may be attached to the inner blade in place of the outer blade to facilitate cutting through hard, solid materials such as rock and cobble. The cutting extensions retain removable, comparatively hard cutting elements at an angle in a manner that permits rotation of the cutting elements to even out wear of the cutting elements.

In another alternative embodiment, a plurality of hard cutting elements is attached to protrude directly from the inner blade in place of the outer blade. The cutting elements have a comparatively low profile to provide minimal stirring or disturbance, thereby enhancing penetration of grainy materials such as sand.

In operation, the reamer is drawn and rotated by the motor so that the outer blades shear away the material of bore of the pilot hole to widen the pilot hole. Drilling fluid is ejected against the bore by the leading jets to enhance penetration and carry away cuttings. The drilling fluid is also ejected against the inner surfaces of the outer blades to cleanse the outer blades and maintain circulation of drilling fluid and cuttings around the reamer.

When the leading side of the outer blades becomes worn, the reamer may be withdrawn from the hole. The leading and trailing subassemblies may be removed and the reamer may be reoriented so that the former trailing side becomes the new leading side. The leading and trailing subassemblies are then reconnected in the coupling opposite to that to which they were previously connected. The reamer may then be inserted back into the hole, or into a new hole, to continue reaming.

In the alternative or in addition to reorienting the reamer, the blade assemblies may simply be replaced. The blade assemblies may simply be welded to the body in such a manner that the inner blades are retained by the grooves in the body. The welds may be scarfed or otherwise neutralized with a cutting torch or other suitable implement to permit removal of the blade assemblies. New blade assemblies may then be inserted such that the inner blades are retained by the grooves. The new blade assemblies may then be welded in place to permit further operation. The blade assemblies may also be replaced as needed to accommodate changes in subterranean formations.

The reamer may be manufactured in a variety of ways. According to one example, the body is cast as a single piece, with the jetting passageways, circulation passageways, grooves, and couplings formed as part of the casting process. The blades are formed by bending or stamping strips of metal to form the outer and inner blades. Receptacles are formed in the inner and/or outer blades to retain the posts.

If cutting elements are used in place of the outer blades, they may be formed through known superhard material manufacturing methods. Cutting extension components may also be cast or formed through the use of other methods known in the art. Welding, mechanical fastening, brazing, or other known techniques may be used to fix the cutting extension components and/or cutting elements in place with respect to the inner blades.

Pieces of solid cylindrical steel stock are cut to length to provide the posts, which are then welded to the inner and outer blades. The trailing and leading subassemblies are made through generally known methods and the completed blade assemblies, the leading subassembly, and the trailing subassembly are attached to the body to provide the completed reamer.

Through the system and method of the present invention, a reamer may be easily manufactured and used to enlarge a pilot hole. The reamer may operate with a low incidence of failure due to wear or cutting blockage, and may have field-replaceable components that enable reconditioning of the reamer and adaptation of the reamer to different formation types. The reamer may also be reversed in orientation to enhance its operating life. These and other features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 7, is not intended to limit the scope of the invention, as claimed, but is merely representative of presently preferred embodiments of the invention.

For this application, the phrases "connected to," "coupled to," and "in communication with" refer to any form of interaction between two or more entities, including mechanical, electrical, magnetic, electromagnetic, and thermal interaction. The phrase "attached to" refers to a form of mechanical coupling that restricts relative translation or rotation between the attached objects. The phrase "attached directly to" refers to a form of attachment by which the attached items are either in direct contact, or are only separated by a single fastener, adhesive, or other attachment mechanism.

Figure 1:
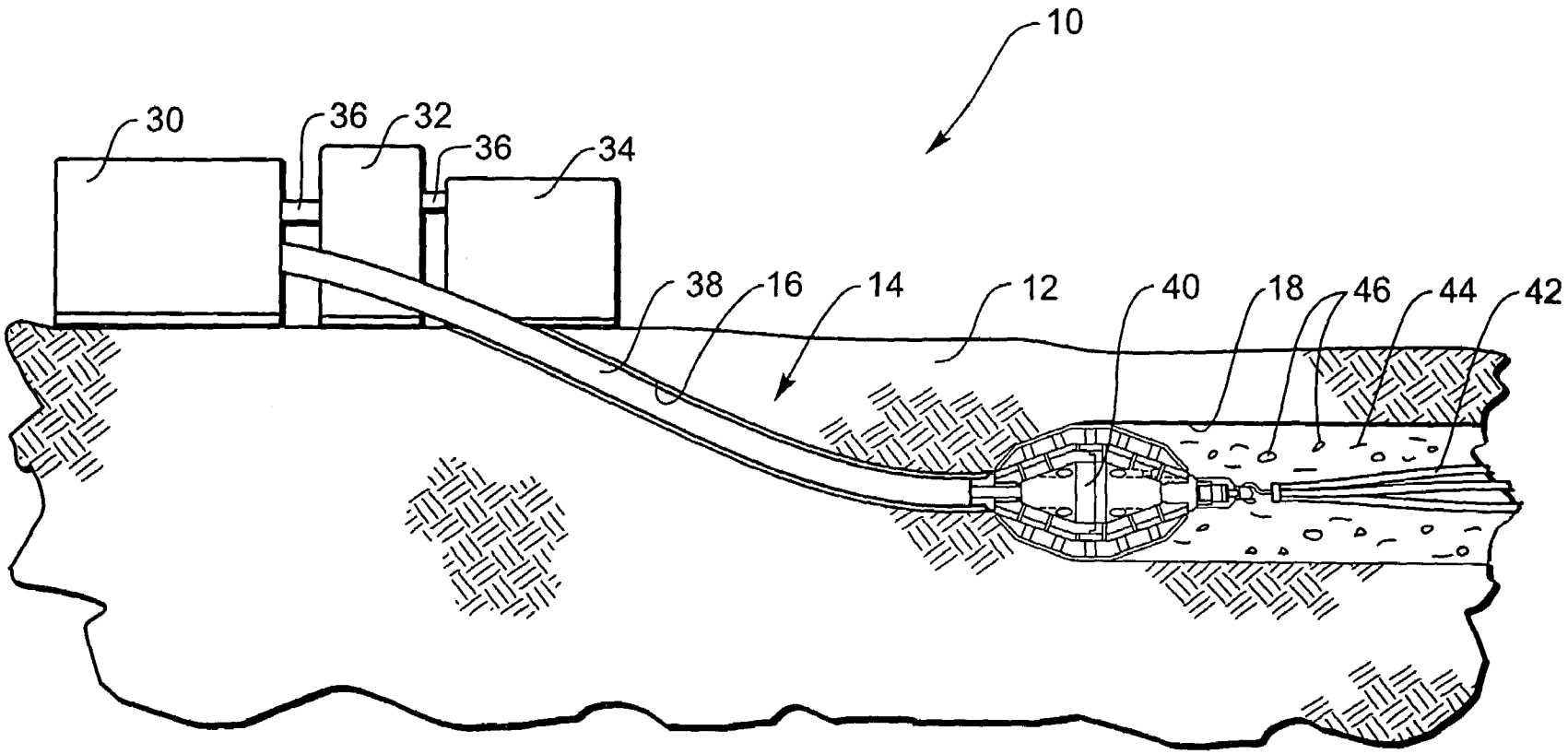
FIG. 1 is a side elevation view of one embodiment of a reaming assembly according to the invention, with the ground sectioned to illustrate subterranean components.

Referring to FIG. 1, a side elevation view illustrates one embodiment of a reaming assembly 10 according to the invention. The reaming assembly operates on a subterranean region 12 in which a pilot hole 14 has been formed along the desired path. The subterranean region 12 has been sectioned in FIG. 1 to illustrate subterranean components of the reaming assembly 10. As shown, the pilot hole 14 has a bore 16 with a comparatively small diameter. The reaming assembly 10 enlarges the pilot hole 14 to provide an enlarged bore 18 suitable for containing utility lines or the like.

As shown, the reaming assembly 10 includes a motor 30, which may be of any type known in the art. The motor 30 provides axial tension as well as torsional force. The reaming assembly 10 also has a pump 32 that draws drilling fluid from a drilling fluid reservoir 34 and pressurizes the drilling fluid. The motor 30, the pump 32, and the fluid reservoir 34 may be interconnected by drilling fluid conduits 36 or the like. The drilling fluid is urged to flow through a length of drill pipe 38, which is drawn and rotated by the motor 30. FIG. 1 is merely an exemplary embodiment; the motor 30, pump 32, and drilling fluid reservoir 34 may be interconnected in a wide variety of ways.

In this application, "drill pipe" refers to steel tubing used to convey mechanical force and/or drilling fluid into a subterranean hole. In this application, "drilling fluid" refers to any of a number of fluids that may be used to facilitate drilling operations. The drilling fluid may be a somewhat thick liquid commonly used in drilling applications and known as "mud." The drilling fluid may alternatively include gel, water, air, or any other suitable fluid or combination of fluids recognized in the drilling arts.

As shown, the drill pipe 38 is attached to a reamer 40. The drill pipe 38 draws the reamer 40 into the bore 16 and simultaneously rotates the reamer 40 to enlarge the pilot hole 14. Utility lines 42 are also attached to the reamer 40 and are drawn behind the reamer 40 so that the bore 16 can be enlarged and the utility lines 42 can be placed with a single operation.

The drilling fluid 44 is expelled by the reamer 40 in a manner that will be described in greater detail subsequently. The drilling fluid 44 helps to facilitate penetration of the subterranean region 12 and serves to carry away cuttings 46 removed from the bore 16 by the reamer 40. The drilling fluid 44 may flow out of the enlarged hole 18 in a direction generally opposed to that of the motion of the reamer 40 to carry the cuttings 46 to the surface and out of the enlarged bore 18.

The reaming assembly 10 of FIG. 1 is only one of many possible embodiments. Those of skill in the art will recognize that many different mechanisms may be used to drive a reamer to enlarge a pilot hole. As shown, the reamer 40 acts as a back reamer because it is pulled through the pilot hole 14. Alternative reaming assemblies may be pushed through a pilot hole through the use of a rearward-mounted drill pipe (not shown). Such reaming assemblies are embraced within the scope of the invention. The reamer 40 of FIG. 1 may be particularly well suited to penetration of materials such as clay.

Figure 2:
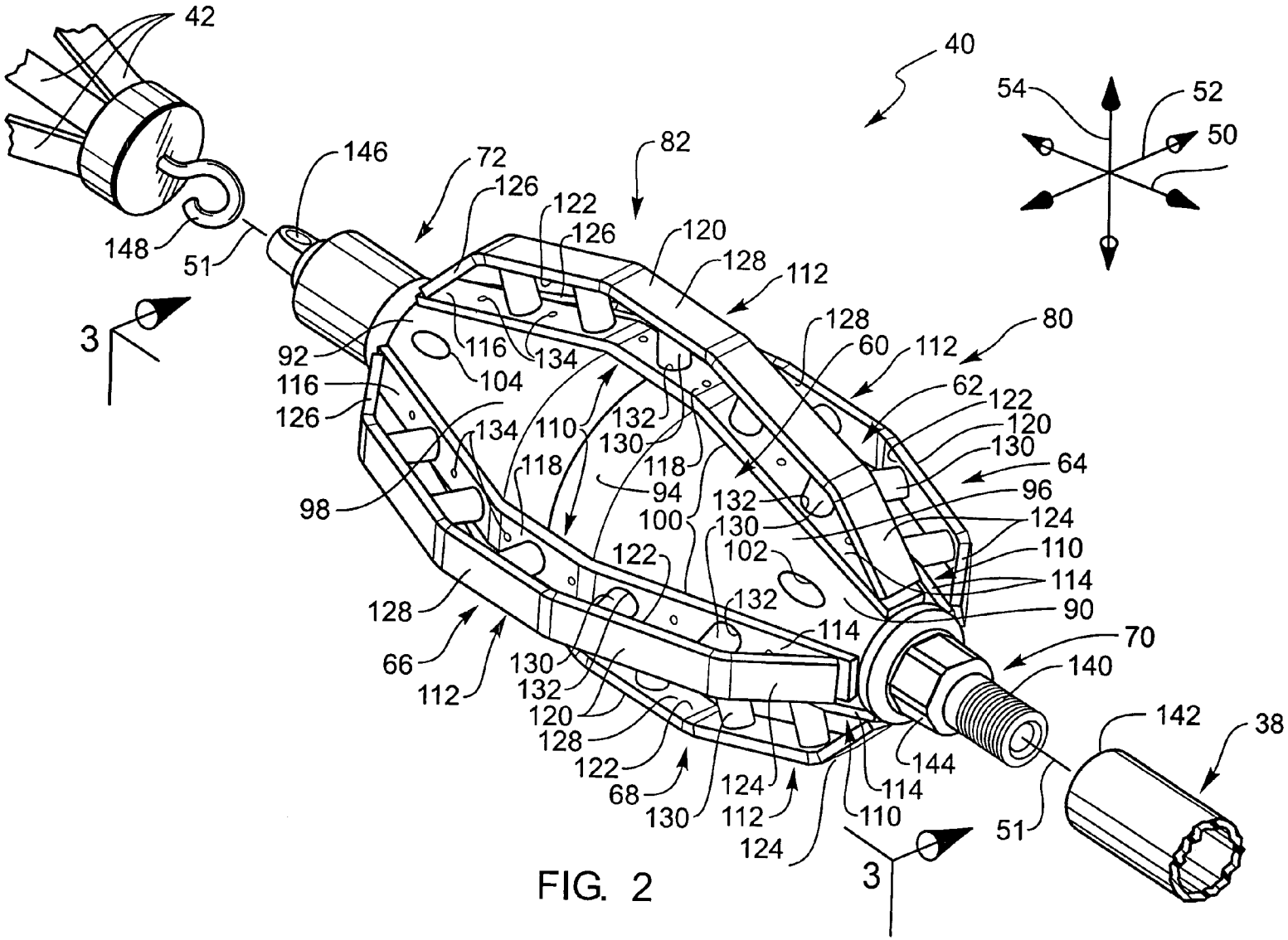
FIG. 2 is perspective view of the reamer of the reaming assembly of FIG. 1, with associated utility line and drill pipe ends.

Referring to FIG. 2, a perspective view illustrates the reamer 40 of the reaming assembly 10 in greater detail. As shown, the reamer 40 has a longitudinal direction 50 along an axis of rotation 51 of the reamer 40. The reamer 40 also has a lateral direction 52 and a transverse direction 54 that are orthogonal to each other and to the longitudinal direction 50. The reamer 40 may be disposed within the bore 16 (not shown in FIG. 2) such that the axis of the reamer 51 lies substantially along an axis of the bore 16.

The reamer 40 has a body 60, a first blade assembly 62, a second blade assembly 64, a third blade assembly 66, a fourth blade assembly 68, a leading subassembly 70, and a trailing subassembly 72. The use of four blade assemblies 62 is merely exemplary; more or fewer blade assemblies could be used. The design of the reamer 40 may be used, with some modifications, to provide a plurality of differently-sized reamers designed to provide various enlarged bore sizes. Larger reamers may have a somewhat smaller length-to-width ratio, and may have a larger number of blade assemblies.

Returning to FIG. 2, the body 60 and the blade assemblies 62, 64, 66, 68 cooperate to define a first reaming section 80 and a second reaming section 82. The first and second reaming sections 80, 82 are substantially identical to each other and are opposed in orientation so that the reamer 40 can effectively penetrate with either of the first and second reaming sections 80, 82 in the leading position. Thus, the first and second reaming sections 80, 82 are substantially symmetrical to each other.

The body 60 may be constructed of steel. In one example, the body 60 is constructed of a chrome-moly steel alloy such as AISI 4140. Other steels such as an AISI ten-series steel, like AISI 1040, may alternatively be used.

The body 60 has a first end 90, a second end 92, and an intermediate portion 94 generally between the first and second ends 90, 92. As shown, the body 60 is generally tapered in such a manner that the first and second ends 90, 92 are of equal width (i.e., equal diameter since the body 60 of FIG. 2 is substantially circular in cross section) and the intermediate portion 94 is wider than the first and second ends 90, 92. In this application, the term "width" applies to any direction perpendicular to the axis 51 of the reamer 40. The intermediate portion 94 need not be circular in cross section, and may thus be wider than the first and second ends 90, 92 along only one direction perpendicular to the axis 51.

The body 60 also has a first generally conical shape 96 that forms a transition between the first end 90 and the intermediate portion 94 and a second generally conical shape 98 that forms a transition between the second end 92 and the intermediate portion 94. In alternative embodiments, a reamer according to the invention may have a body with a non-circular cross section and/or a tapered shape that is not generally conical. For example, a body of a reamer could be elliptical, stepped, or otherwise shaped in a manner different from that illustrated in FIG. 2.

As shown, the body 60 has a plurality of grooves 100 that extend from the first end 90 to the second end 92. The grooves 100 are shaped to receive the blade assemblies 62, 64, 66, 68 to facilitate secure but removable attachment of the blade assemblies 62, 64, 66, 68 to the body 60.

The body 60 also has a plurality of first end jets 102 and a plurality of second end jets 104. The first end jets 102 are oriented to eject the drilling fluid 44 toward the first end 90 of the body 60, and toward the bore 16 if the first end 90 is the leading end of the reamer 60. The second end jets 104 are similarly oriented to eject the drilling fluid 44 toward the second end 92 of the body 60.

The first end jets 102 are arrayed around the axis of rotation 51 of the reamer 40 in radially symmetrical fashion, so that one of the first end jets 102 is disposed between each adjacent pair of the blade assemblies 62, 64, 66, 68. The second end jets 104 are similarly arrayed around the axis of rotation 51. The first and second end jets 102, 104 are substantially identical but face opposite directions, and are thus substantially symmetrically opposed to each other. If desired, additional jets, fewer jets, or even no jets may be used in conjunction with the general design of the reamer 60.

Each of the blade assemblies 62, 64, 66, 68 has a generally bowed shape with an inner blade 110 and an outer blade 112. In this application, the term "blade" simply denotes structural rigidity, and does not require any specific dimensional ratio or thickness. The term "generally bowed" does not refer to any precise amount of curvature, but rather to an overall arced shape, which may include segments angled with respect to each other to form an arc.

The inner and outer blades 110 may each be constructed of steel, such as an AISI ten-series steel. Each of the inner blades 110 has a first extremity 114, a second extremity 116, and a central portion 118 disposed generally between the first and second extremities 114, 116. Each of the inner blades 110 has a generally bowed shape that follows the profile of the associated groove 100 of the body 60, and thus follows the profile of the body 60. Consequently, the central portion 118 of each inner blade 110 does not lie along a straight line between the first and second extremities 114, 116, but is nevertheless between the associated first and second extremities 114, 116 with respect to the path along which each inner blade 110 extends.

Each of the outer blades 112 has an outer surface 120 facing generally outward from the body 60 and an inner surface 122 facing generally toward the body 60. Each of the outer blades 112 also has a first extremity 124, a second extremity 126, and a central portion 128 generally between the first and second extremities 124, 126. Like the inner blades 110, each of the outer blades 112 has a generally bowed shape so that the central portion 128 does not lie along a straight line connecting the first and second extremities 124, 126.

The outer blades 112 may each be hardened to provide abrasion resistance. For example, the outer surface 120 of the outer blade 112 may be hardened through a process such as hardfacing. Hardfacing is the application of a Nickel substrate with carbide flakes that add hardness to a surface. The outer blade 112 may be cut and stamped to shape, and then hardfaced using known procedures. The outer surface 120 may also be treated according to a wide variety of other hardening methods. The hardness of the outer surface 120 may provide exceptional wear resistance.

Each of the blade assemblies 62, 64, 66, 68 also has a plurality of posts 130 that couple the inner and outer blades 110, 112 to each other. The posts 130 may be constructed of steel, such as AISA 1040. The posts 130 may seat within as plurality of receptacles 132 distributed along the length of the inner blades 110. Each of the receptacles 132 takes the form of a shallow, generally circular hole designed to properly position the corresponding post 130. If desired, similar receptacles (not shown) may be formed in the inner surfaces 122 of the outer blades 112. The posts 130 may be welded or otherwise attached to the inner and outer blades 110, 112.

As illustrated, each of the inner blades 110 has an array of circulation openings 134 facing toward the inner surface 122 of the corresponding outer blade 112. The circulation openings 134 release pressurized drilling fluid to keep the blade assemblies 62, 64, 66, 68 relatively clear of cuttings. The circulation openings 134 thus help to reduce the incidence of stoppage due to clogging of the reamer 40 with cuttings. If desired, the circulation openings 134 may optionally be plugged to concentrate drilling fluid flow in the first end jets 102 and/or the second end jets 104.

The leading subassembly 70 is designed to mate with the drill pipe 38. More precisely, the leading subassembly 70 has a threaded post 140 designed to be engaged within a threaded receptacle 142 of the drill pipe 38. The leading subassembly 70 also has a hexagonal coupling 144 that facilitates attachment of the leading subassembly 70 to the drill pipe 38.

The trailing subassembly 72 has an eyelet 146 designed to interlock with a hooked coupling 148 attached to the ends of the utility lines 42. The trailing subassembly 72 permits rotation of the eyelet 146 with respect to the body 60 to prevent the utility lines 42 from becoming twisted during the reaming operation.

Figure 3:
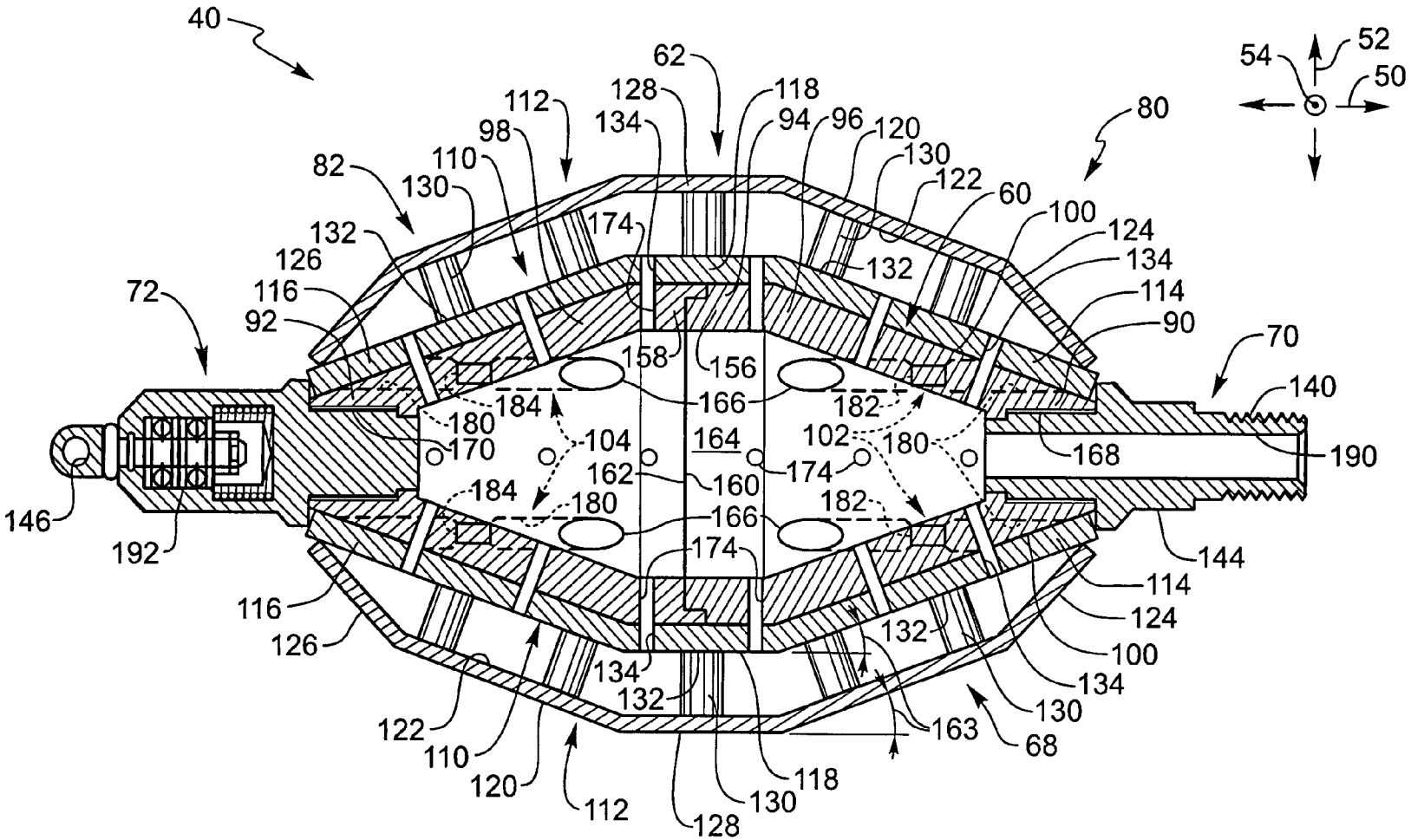
FIG. 3 is a side elevation, section view of the reamer of FIG. 1.

Referring to FIG. 3, a side elevation, section view illustrates the reamer 40 of FIGS. 1 and 2. As illustrated, the body 60 of the reamer 40 may be constructed of a first portion 156 and a second portion 158. The first and second portions 156, 158 may be cast, machined, or formed by any other suitable process. The first and second portions 156, 158 are similar to each other except that the first portion 156 has an annular protrusion 160 and the second portion 158 has an annular recess 162 designed to receive the annular protrusion 160. The annular recess 162 and the annular protrusion 160 may be relatively sized to interfere slightly with each other so that the first and second portions 156, 158 can be press fit together.

The first and second portions 156, 158 may alternatively be welded or otherwise attached together. If desired, the first and second portions 156, 158 may have holes (not shown) or other features that can be used to attach the first and second portions 156, 158 together with fasteners. According to yet another alternative embodiment, the body 60 may be unitarily formed, for example, by casting. In such a case, some type of filler material, such as packed sand, may be used to form the shape of the interior cavity 164.

The body 60 has an angle of attack 163, which is the angle at which the first and second conical shapes 96, 98 slope away from the intermediate portion 94. As shown, the outer blades 112 have the same angle of attack proximate their central portions 128. A larger angle of attack provides more aggressive cutting, while a smaller angle provides less aggressive cutting. The angle of attack 163 may be selected based on factors such as the capabilities of the motor 30, the overall size of the reamer 40, and the composition of the bore, e.g., type of subterranean formation to be penetrated.

In a comparatively large reamer, if the angle of attack 163 is small, the length and weight of the reamer may become prohibitive. According to exemplary embodiments, the angle of attack 163 may range from about 10° to about 50°. Further, the angle of attack 163 may range from about 15° to about 35°. Yet further, the angle of attack 163 may be about 20°.

As shown, the body 60 has an interior cavity 164 into which the drilling fluid 44 flows. Jetting holes 166 are formed in the body 60 and in communication with the interior cavity 164. The body 60 also has a first coupling 168 and a second coupling 170, each of which are in communication with the interior cavity 164.

The first and second couplings 168, 170 may be substantially identical to each other so that each of the first and second couplings 168, 170 can interchangeably receive either of the leading subassembly 70 and the trailing subassembly 72. As illustrated, the first coupling 168 retains the leading subassembly 70 and the second coupling 170 retains the trailing subassembly 72. The leading and trailing subassemblies 70, 72 may be welded, interference fit, threadably attached, or otherwise fixed in place within the first and second couplings 168, 170.

The body 60 also has a plurality of circulation passageways 174, each of which is in communication with one of the circulation openings 134 of the inner blades 110. The circulation passageways 174 conduct the drilling fluid 44 from the interior cavity 164 to the circulation openings 134 to allow the drilling fluid 44 to exit the body 60 proximate each of the blade assemblies 62, 64, 66, 68.

Each of the first end jets 102 and the second end jets 104 has a jetting passageway 180 in communication with one of the jetting holes 166. Each of the jetting passageways 180 of the first end jets 102 contains a first insert 182. Similarly, each of the jetting passageways 180 of the second end jets 104 contains a second insert 184. The first and second inserts 182, 184 may have exterior threads that engage threads within the jetting passageways 180. The first and second inserts 182, 184 also have an interior hexagonal wall designed to be engaged by an end of an Allen wrench.

The first and second inserts 182, 184 may be selected from a plurality of inserts having different orifice sizes. Thus, the flow rate and/or pressure of drilling fluid 44 expelled by the first and second end jets 102, 104 may be varied. Consequently, the jetting action provided by the reamer 40 may be adapted to suit variations in factors such as the type of formation to be penetrated, the power of the pumping equipment used, and the length of the enlarged bore 18.

The inserts 182, 184 may also be plugs. If desired, the inserts 182 or 184 on the leading end of the reamer 40 may have orifices to permit jetting while the remaining inserts 182 or 184 may be plugs that block drilling fluid flow to concentrate the flow of drilling fluid 44 in the jets 102 or 104 of the leading end.

As illustrated, the leading subassembly 70 has an interior passageway 190 designed to convey the drilling fluid 44 from the drill pipe 38 (not shown in FIG. 3) into the interior cavity 164 of the body 60. The trailing subassembly 72 has a bearing assembly 192 that permits relatively free rotation of the eyelet 146. As mentioned previously, rotation of the eyelet 146 prevents the utility lines 42 from becoming twisted during the reaming operation.

The reaming assembly 10 is relatively simple in operation. The motor 30 exerts tension and torsional force on the drill pipe 38. The tension and torsion are transmitted to the reamer 40 and the reamer 40 rotates about the axis 51 and presses against the bore 16. The leading edges of the outer blades 112 scrape against the bore 16, thereby abrading away material.

The pump 32 pressurizes the drilling fluid 44 and conveys it through the drill pipe 38 to the reamer 40. The drilling fluid 44 exits the first end jets 102 and/or the second end jets 104 to impinge against the bore 16, thereby removing additional material and conveying the cuttings 46 through the enlarged bore 18, away from the reamer 40. Reaming continues until the reamer 40 has enlarged the entire pilot hole 14 or the desired portion thereof.

As reaming progresses, the outer blades 112, and possibly other parts of the reamer 40, can be expected to sustain wear. The reamer 40 can be removed from the enlarged bore 18 for field maintenance. Wear is likely to be highly concentrated in the leading edges of the outer blades 112. Hence, the reamer 40 can be relatively easily reconditioned for further use by replacing the blade assemblies 62, 64, 66, 68 or by reversing the orientation of the reamer 40.

More precisely, blade assemblies 62, 64, 66, 68 may easily be "field replaced," or replaced on-site. The blade assemblies 62, 64, 66, 68 may initially be attached to the body 60 by seating the inner blades 110 into the grooves 100 and welding along the exposed edges of the inner blades 110 to affix the inner blades 110 to the body 60.

The blade assemblies 62, 64, 66, 68 may be "field removed," or removed on-site, in a variety of ways. For example, a cutting torch may be used to scarf the bead of the welds, thereby breaking the welds to permit removal of the inner blades 110 from the grooves 100. New blade assemblies may then be installed by seating the inner blades of the new blade assemblies within the grooves 100 and welding the exposed edges of the inner blades to the body 60 in the same manner as with the blade assemblies 62, 64, 66, 68.

In the alternative, the reamer 60 may be reoriented 180° to provide more even wear characteristics. As illustrated in FIG. 3, the first coupling 168 is attached to the leading subassembly 70 so that the first reaming section 80 of the reamer 60 leads. When the outer blades 112 within the first reaming section 80 begin to sustain heavy wear, the leading and trailing subassemblies 70, 72 may be removed from the first and second couplings 168, 170, respectively.

The reamer 60 may then be reoriented so that the second reaming section 82 is in the leading position. The leading subassembly 70 may be attached to the second coupling 170 and the trailing subassembly 72 may be attached to the first coupling 168. Thus, the operating life of the reamer 40 may be effectively doubled by inducing wear of both sides of the reamer 40.

The reamer 40 may be manufactured according to a variety of different methods. According to one method, the first and second portions 156, 158 of the body 60 are first made by a casting operation as described above. The first and second portions 156, 158 are attached together.

The inner and outer blades 110, 112 are each formed by cutting a piece of stock steel plate to length and stamping the plate to provide the desired generally bowed shape. Each of the posts 130 is formed by cutting a piece of solid cylindrical steel stock to length. The blade assemblies 62, 64, 66, 68 are each assembled by welding the inner and outer blades 110, 112 to the posts 130. The blade assemblies 62, 64, 66, 68 are welded to the body 60 in the manner described previously.

The components of the leading and trailing subassemblies 70, 72 are formed by one or more operations, which may include casting, turning, tapping, and similar processes. The various components of the leading and trailing subassemblies 70, 72 may then be assembled to form the completed leading and trailing subassemblies 70, 72. The leading and trailing subassemblies 70, 72 are installed in the first and second couplings 168, 170 by welding, interference fitting, threaded attachment, or the like, as mentioned previously.

The proper first and second inserts 182, 184 are then selected. As mentioned previously, this may be done based on factors such as the type of formation to be penetrated. The selected first and second inserts 182, 184 are installed in the jetting passageways 80 by using an Allen wrench to twist the threads of the inserts 182 into engagement with the threads within the jetting passageways 180. The reamer 40 is then ready to be attached to the hooked coupling 148 and the drill pipe 38.

As mentioned previously, the outer blades 112 may be formed of an AISI ten-series steel. The outer blades 112 may be formed of a variety of steels known as "plow steels." Such blades will effectively penetrate some subterranean formations. However, for different formation types, it may be advisable to replace the blade assemblies 62, 64, 66, 68 with alternative blade assembly types. Many such alternative blade assembly types exist. Two exemplary alternative blade assemblies will be shown and described in connection with FIGS. 4 and 5, as follows.

Figure 4:
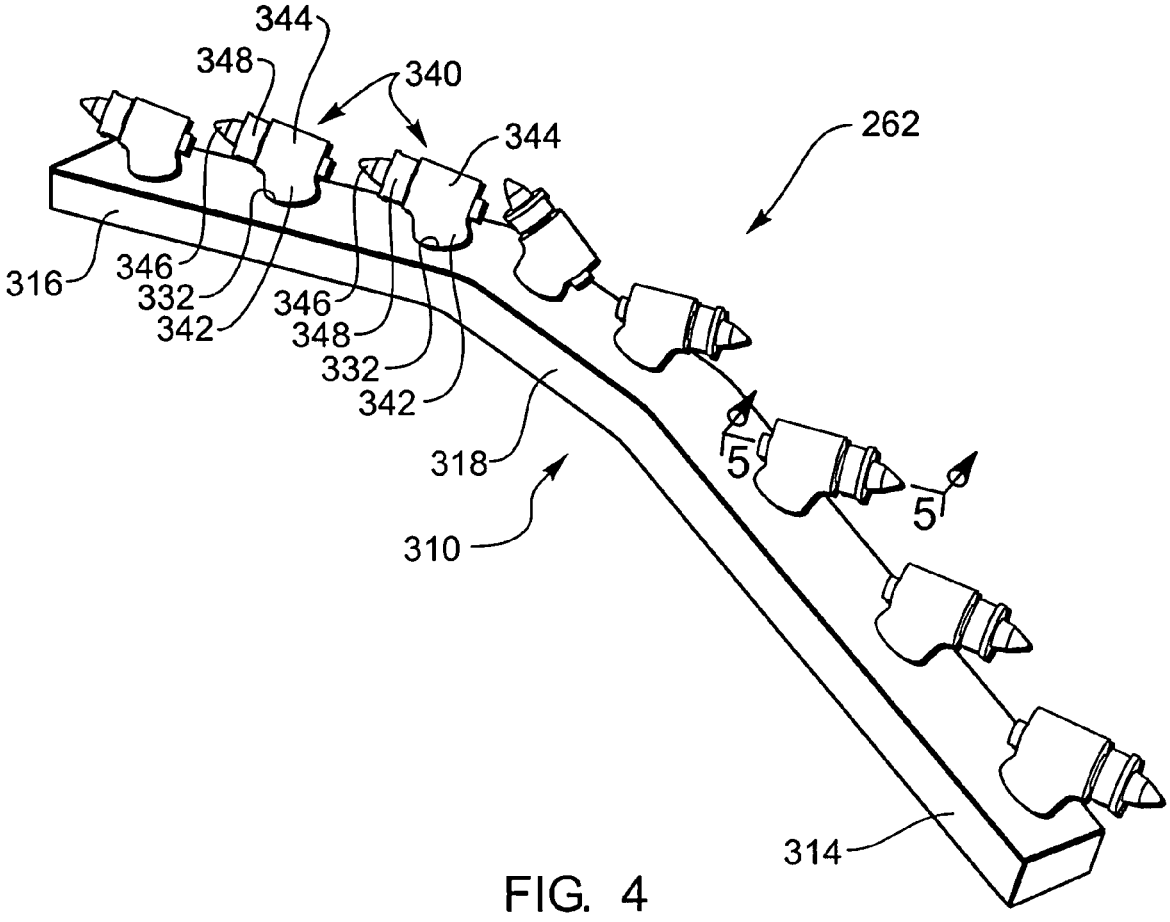
FIG. 4 is a perspective view of a blade assembly usable in conjunction with the body of the reamer of FIG. 1, according to one alternative embodiment of the invention.

Referring to FIG. 4, a perspective view illustrates a blade assembly 262 according to one alternative embodiment of the invention. The blade assembly 262 may be uniquely suited to penetration of rock and cobble formations. Like the blade assemblies 62, 64, 66, 68 of the preceding embodiment, the blade assembly 262 has an inner blade 310. The inner blade 310 may be similar the blade assemblies 62, 64, 66, 68, with a generally bowed shape defined by a first extremity 114, a second extremity 116, and a central portion 118.

The inner blade 310 has a plurality of receptacles 332 arrayed along its length. The receptacles 332 may be generally circular depressions formed in the inner blade 310. A plurality of cutting extensions 340 are seated in the receptacles 332. The cutting extensions 340 essentially take the place of an outer blade 112 by extending outward from the inner blade 310 to contact the bore 16. Each of the cutting extensions 340 has a shank 342, a head 344, and a cutting element 346.

The shank 342 of each cutting extension 340 is seated in the corresponding receptacle 312 and fixed therein via mechanical fastening, brazing, welding, or some other process in such a manner that the shank 342 protrudes outward from the inner blade 310. The head 344 extends at an angle nearly perpendicular to the shank 342. The head 344 is also angled forward and toward the direction in which the outer blade 312 is to rotate. The cutting element 346 is attached to the end of the head 344 and faces the material to be penetrated due to the orientation of the head 344. The cutting element 346 is retained by a cutting element retainer 348.

As illustrated in FIG. 4, half of the heads 344 are angled generally along one direction while the other half are angled generally along the opposite direction. Thus, the orientation of the blade assembly 262 can be reversed to permit either the first extremity 314 or the second extremity 316 to lead during penetration. The body 60 (shown in FIG. 3) is then able to rotate in a single direction regardless of which of the extremities 314, 316 is in the leading position.

The blade assembly 262 may be used in conjunction with other, similar blade assemblies (not shown). The other blade assemblies may also have cutting extensions similar to the cutting extensions 340 of the blade assembly 262. The cutting extensions of the blade assemblies may be offset slightly from each other along the length of the associated inner blades. Thus, the cutting extensions move in a plurality of circular pathways that are far more closely-spaced than the cutting extensions of any individual blade assembly to more uniformly remove the material of the bore 16.

Figure 5:
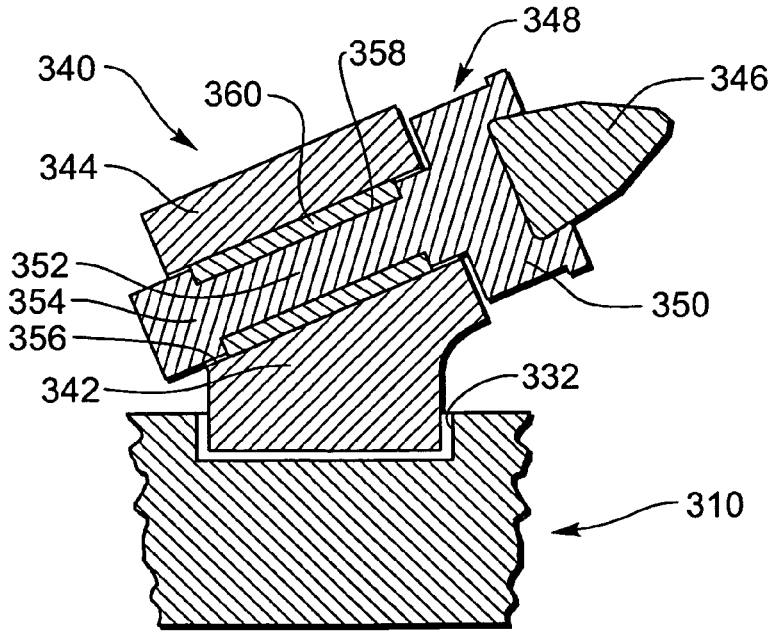
FIG. 5 is a side elevation, section view of a cutting extension of the blade assembly of FIG. 4.

Referring to FIG. 5, a side elevation, section view illustrates one of the cutting extensions 340 and a corresponding portion of the inner blade 310. As shown, the cutting element retainer 348 has a leading end 350, a shaft 352, and a trailing end 354. The shaft 352 couples the leading end 350 to the trailing end 354. The cutting element retainer 348 is seated within an aperture 356 of the head 344. The shaft 352 has a stepped down portion 358 in which a split ring 360 is seated. The split ring 360 has an undeflected diameter slightly larger than the inside diameter of the aperture 356. Hence, the split ring 360 presses outward against the aperture 356 to permit rotation of the stepped down portion 358 within the split ring 360.

Consequently, the cutting element retainer 348 and the cutting element 346 are able to rotate during penetration of the bore 16. As the cutting element 346 abrades the bore 16, the cutting element 346 is continuously rotated to provide relatively even wear around the circumference of the cutting element 346. The leading end 350 is larger than the aperture 356, and may thus be pressed against the head 344 when the cutting extension 340 contacts the bore 16.

The cutting element retainer 348 may be easily removable for replacement to recondition the blade assembly 262 for further use. For example, a user may simply press against the exposed trailing end 354 of the cutting element retainer 348 to urge the split ring 360 to slide along the interior diameter of the aperture 356, thereby permitting the cutting element retainer 348 to move through the aperture 356. The cutting element retainer 348 may then be replaced or repaired for further use. The cutting extensions 340 may alternatively or additionally be removable and replaceable in their entirety.

As shown, the cutting element 346 may have a generally parabolic shape. However, in alternative embodiments, cutting elements may be flat, domed, conical or otherwise shaped in any desired manner. The cutting elements 346 may be constructed of comparatively hard materials such as polycrystalline diamond (PCD), cubic boron nitride (CBN), tungsten carbide, or the like.

Figure 6:
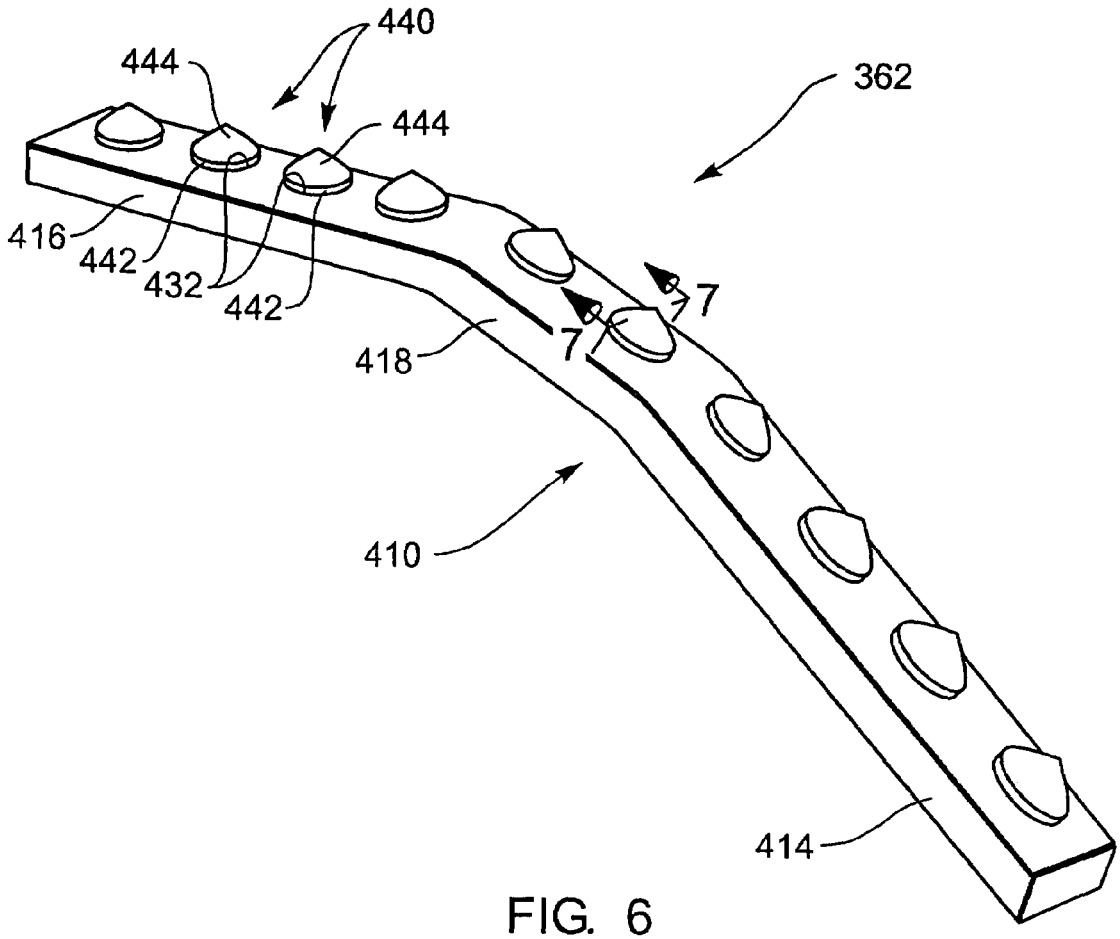
FIG. 6 is a perspective view of a blade assembly usable in conjunction with the body of the reamer of FIG. 1, according to another alternative embodiment of the invention.

Referring to FIG. 6, a perspective view illustrates a blade assembly 362 according to another embodiment of the invention. The blade assembly 362 may be particularly well suited to penetration of grainy materials such as sand. The blade assembly 362 has an inner blade 410 similar in shape to the inner blades 110, 310 of the blade assemblies 62, 262. The inner blade 410 has a generally bowed shape with a first extremity 414, a second extremity 416, and a central portion 418 generally between the first and second extremities 414, 416.

A plurality of receptacles 432 are distributed along the length of the inner blade 410. Like the receptacles 332 of the previous embodiment, the receptacles 432 may be generally circular depressions formed in the inner blade 410. A plurality of cutting elements 440 may be seated directly in the receptacles 432. The cutting elements 440 may protrude only a comparatively small distance from the inner blade 410 to minimize the disturbance of the material of the bore 16. Since materials such as sand may tend to collapse and trap a reamer, penetration without excessive disturbance is desirable. As illustrated, each of the cutting elements 440 has a shank 442 and a head 444.

Figure 7:
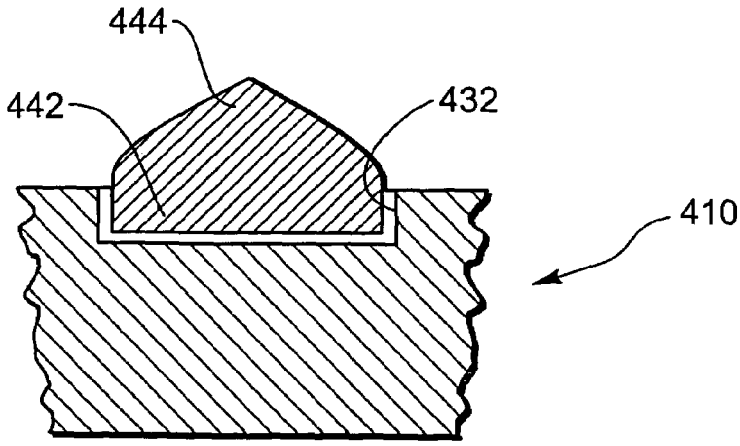
FIG. 7 is a side elevation, section view of a cutting element of the blade assembly of FIG. 6.

Referring to FIG. 7, a side elevation, section view illustrates one of the cutting elements 440 and a corresponding portion of the inner blade 410. The shank 442 of the cutting element 444 may be mechanically fastened, brazed, welded, or otherwise attached within the corresponding receptacle 432. The head 444 then protrudes outward from the inner blade 410.

Although the head 444 of the cutting element 440 of FIG. 7 has a generally conical shape, the head 444 may have any of a number of shapes, including domed, parabolic, flat, pyramidal, and faceted shapes. As with the previous embodiment, the cutting elements 440 may be constructed of comparatively hard materials such as polycrystalline diamond (PCD), cubic boron nitride (CBN), tungsten carbide, or the like. The cutting elements 440 may be removable from the receptacles 432 through the use of known methods to enable replacement or repair of the cutting elements 440.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A blade assembly for use in conjunction with a body of a reamer to facilitate enlargement of a bore of a subterranean pilot hole, the blade assembly comprising:

an inner blade having a first extremity, a second extremity, and a central portion between the first and second extremities, wherein the inner blade is shaped to lie along the body for attachment thereto, wherein the inner blade comprises a plurality of circulation openings distributed along a length of the inner blade in alignment with a plurality of circulation openings of the body to permit passage of drilling fluid from an interior of the body to the outer blade;

an outer blade having a first extremity, a second extremity, and a central portion between the first and second extremities, wherein the inner and outer blades are attached together such that the first extremities are adjacent to each other, the second extremities are adjacent to each other, and the central portions are spaced apart such that a gap remains between the central portions.

2. The blade assembly of claim 1, further comprising a plurality of posts extending between the inner and outer blades to attach the inner and outer blades to each other.

3. The blade assembly of claim 1, wherein each of the inner and outer blades has a generally bowed shape such that the blade assembly has a generally bowed shape.

* * * * *